US009132992B2

(12) United States Patent
Walker

(10) Patent No.: US 9,132,992 B2
(45) Date of Patent: Sep. 15, 2015

(54) VARIABLE DOOR COUPLING

(75) Inventor: Willy Walker, Buchrain (CH)

(73) Assignee: Inventio AG, Hergiswil (CH)

( * ) Notice: Subject to any disclaimer, the term of this patent is extended or adjusted under 35 U.S.C. 154(b) by 431 days.

(21) Appl. No.: 13/484,477

(22) Filed: May 31, 2012

(65) Prior Publication Data

US 2012/0305336 A1 Dec. 6, 2012

(30) Foreign Application Priority Data

May 31, 2011 (EP) ..... 11168233

(51) Int. Cl.
*B66B 13/12* (2006.01)
*B66B 19/00* (2006.01)

(52) U.S. Cl.
CPC ..... *B66B 13/12* (2013.01); *B66B 19/007* (2013.01)

(58) Field of Classification Search
CPC ..... B66B 13/12; B66B 19/007
USPC ..... 187/330, 319; 49/116, 118
See application file for complete search history.

(56) References Cited

U.S. PATENT DOCUMENTS 4,926,974 A * 5/1990 Morris et al. ..... 187/319
5,819,877 A * 10/1998 Rivera et al. ..... 187/314
5,988,320 A * 11/1999 Mittermayr ..... 187/319
6,189,658 B1 * 2/2001 Karner ..... 187/319
7,100,745 B2 * 9/2006 Bisang et al. ..... 187/319
7,398,862 B2 * 7/2008 Dziwak ..... 187/319
2007/0295564 A1 * 12/2007 Someya ..... 187/319

FOREIGN PATENT DOCUMENTS

EP 1541517 A1 6/2005
EP 2168902 A1 * 7/2007
EP 1820766 A1 8/2007
FR 2823495 A1 10/2002
JP 62-098678 U 6/1987

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A cage-door/shaft-door coupling of an elevator installation includes at least one pivot lever pivotably mounted at an axis of rotation associated therewith, wherein the pivot lever has a joint point and wherein the cage-door/shaft-door coupling further includes a first entrainer runner, which is mounted at the joint point, wherein the pivot lever includes a base member and a setting element fastened to the base member by way of a settable fixing means and wherein the settable fixing means enables a change in the spacing between the joint point and the associated axis of rotation.

14 Claims, 4 Drawing Sheets

VARIABLE DOOR COUPLING

CROSS-REFERENCE TO RELATED APPLICATION

This application claims priority to European Patent Application No. 11168233.2, filed May 31, 2011, which is incorporated herein by reference.

FIELD

The disclosure relates to a cage-door/shaft-door coupling, for example, in an elevator installation.

BACKGROUND

Cage-door/shaft-door couplings are used in order to couple a cage-door leaf, which is actuated by a door drive, with a shaft-door leaf. An elevator cage comprises a door drive and a cage door with a cage-door leaf. In addition, arranged along an elevator shaft in which the elevator cage can be vertically moved are individual shaft doors each with a respective shaft-door leaf. The shaft doors are usually closed. However, in the case of appropriate positioning at a predefined stopping position of the elevator cage in the elevator shaft an interior space of the elevator cage can be entered via one of the shaft doors and the cage door. This can require synchronous opening and closing of the cage-door leaf and the shaft-door leaf of this stopping position, which can be ensured by the cage-door/shaft-door coupling.

The cage-door/shaft-door coupling can be fixed to a cage-door leaf. A coupling device by which the cage-door/shaft-door coupling can be actuated for the purpose of coupling is accordingly arranged at the shaft-door leaf at the predefined stopping position.

In the course of modernization of elevator installations, components of old door systems, including the cage-door/shaft-door coupling can be exchanged. In that case, the coupling devices can be retained. This can require different constructions of the cage-door/shaft-door couplings in correspondingly different elevator installations.

SUMMARY

In some embodiments, a cage-door/shaft-door coupling for use in an elevator installation comprises a first pivot lever which is pivotably mounted at an axis of rotation associated therewith, wherein the pivot lever has a joint point, and a second pivot lever which is pivotably mounted at an axis of rotation associated therewith, wherein the second pivot lever has a joint point, wherein the joint points of the first and second pivot levers and the axes of rotation associated with the two pivot levers represent corner points of a parallelogram in a plane extending at right angles to these axes of rotation, and a first entrainer runner which is mounted at the joint points, wherein the first pivot lever comprises a base member and a setting element fastened to the base member by way of a settable fixing means and wherein the settable fixing means enables change in a spacing between the joint point and the associated axis of rotation.

At least some embodiments are based on the recognition that demands on cage-door/shaft-door couplings of different elevator installations can differ. That can relate to dimensions or movement sequences of individual components of the cage-door/shaft-door coupling in the coupling of the doors. Currently, different cage-door/shaft-door couplings are produced for the purpose of modernization activities. However, in the case of modernization activities it can be desirable to be able to replace every old cage-door/shaft-door coupling by a cage-door/shaft-door coupling of a single form of construction. In that case it is to be noted that in an unactuated state, such as, for example, during an elevator travel, minimum and maximum spacings of entrainer runners from the coupling elements associated therewith are not fallen below or exceeded. It can thus be ensured that on the one hand the entrainer runners and the associated coupling elements do not come into contact during an elevator travel and on the other hand that the coupling elements can be actuated by the entrainer runners during the coupling process.

At least some embodiments minimize production and assembly effort by changing a construction of the cage-door/shaft-door coupling such that this new cage-door/shaft-door coupling to be installed at the time of modernization can be combined with all different coupling devices which are matched to the old cage-door/shaft-door couplings that are to be exchanged. A cage-door/shaft-door coupling is shown which can provide different runner spacings without a component of the cage-door/shaft-door coupling having to be exchanged. This is achieved by a possible change in length of a rotating pivot lever at which the entrainer runner is mounted. In some cases, the cage-door/shaft-door coupling can be fixed not only to the cage door, but also the shaft door.

In a development of the cage-door/shaft-door coupling the second pivot lever comprises a base member associated with the second pivot lever and a setting element which is fastened to this base member by way of a settable fixing means and which is associated with the second pivot lever. A simple possibility is thus given for undertaking the alignment of the first entrainer runner with the help of a change of a spacing between the joint point and the associated axis of rotation of the second pivot lever in correspondence with the change in the spacing between the joint point and the associated axis of rotation of the first pivot lever. The second pivot lever can in that case be constructed just like the first pivot lever. The setting element and the base member of the second pivot lever can also be constructed differently from those of the first pivot lever.

In a development of the cage-door/shaft-door coupling the axis of rotation is associated with the base member and the joint point with the setting element. A displacement and a subsequent fixing of the setting element at the base member enables change of the spacing in simple mode and manner.

In developments of the cage-door/shaft-door coupling the setting element and/or the base member associated with this setting element has or have a slot or a row of holes or a screw connection as part of the settable fixing means. The change of the runner spacing can accordingly be realized very simply. It can take place steplessly for the purpose of a high degree of variability or in steps in favor of a rapid capability of adjustment.

In a development of the cage-door/shaft-door coupling the setting element and/or the base member associated with this setting element, which has or have a skit or a row of holes, has or have a toothing within the mutual contact region thereof. A capability of setting the variable fixing between the setting element and the base member is thus simplified.

In a development the cage-door/shaft-door coupling comprises a second entrainer runner, wherein the pivot lever comprises a second setting element and has a second settable fixing means, wherein a second joint point is associated with the at least one second setting element, wherein the second entrainer runner is mounted at the second joint point, and wherein the second settable fixing means enables a change in a spacing between the second joint point and the associated axis of rotation. In a development alternative thereto the second entrainer runner is provided so as to be fixed to a door parallel to the first entrainer runner. Thus, the cage-door/shaft-door coupling can be operated with different coupling devices, which are distinguished by, inter alia, different courses of relative movements of the respective two coupling elements of a coupling element pair. A runner spacing, which is a spacing of the two entrainer runners in the unactuated state, can be preset by means of the settable fixable means which are present.

In a development of the cage-door/shaft-door coupling the entrainer runner comprises entrainer runner elements. It can be advantageous that dimensions of the entrainer runner can be changed. That can relate to, in particular, a length of the entrainer runner.

In a development of the cage-door/shaft-door coupling a first one of the entrainer runner elements is an elongate section, a second one of the entrainer runner elements is a first runner terminal and a third one of the entrainer runner elements is a second runner terminal, wherein the two runner terminals are fastened to the two ends of the elongate section. The elongate section can be shortened and the entire cage-door/shaft-door coupling thus quickly adapted to conditions at an installation location.

BRIEF DESCRIPTION OF THE DRAWINGS

The disclosure is explained in more detail in the following by way of figures, in which.

DETAILED DESCRIPTION

Figure 1:
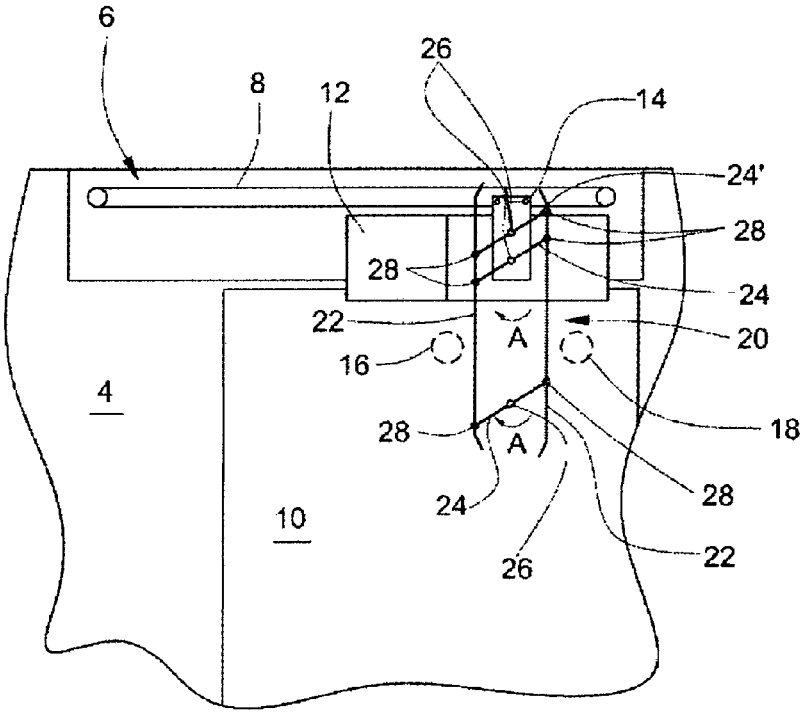
Fig. 1 (Prior Art)
FIG. 1 shows an upper region of an elevator cage in a front view with a cage-door/shaft-door coupling according to the prior art.

FIG. 1 shows an upper region of an elevator cage 4 according to the prior art in a front view. The elevator cage 4 is located in an elevator installation (not illustrated). A door drive 6, which opens and closes a cage door leaf 10 of the elevator cage 4, is fixed to the elevator cage 4. The door drive 6 comprises a drive element 8. A cage-door/shaft-door coupling 20 is fixed to a carriage 12 which is connected with the cage door leaf 10. Coupling elements 16, 18, for example rollers or pins, at the shaft door side as components of a coupling device at the shaft door side are illustrated by dashed lines. The coupling device at the shaft door side is arranged at a shaft door (not illustrated) and associated with the cage-door/shaft-door coupling 20.

The cage-door/shaft-door coupling 20 comprises a plurality of pivot levers 24, 24', which are pivotably mounted at axes 26 of rotation, and two entrainer runners 22, which are mounted at joint points 28 of the pivot levers 24, 24'. One of the two pivot levers 24 can be mounted on the cage-door leaf 10. A first one of the coupling elements 16 is associated with a first one of the two entrainer runners 22 and a second one of the coupling elements 18 is associated with a second one of the two entrainer runners 22. An actuating device 14 is connected with the drive element 8 and with the pivot lever 24'. The actuating device 14 accordingly couples the cage-door/shaft-door coupling 20 to the door drive 6.

The cage-door/shaft-door coupling 20 is shown in an unactuated state. A first part movement of the door drive 6 causes a relative movement of the actuating device 14 relative to the elevator cage 4. Consequently, the pivot levers 24, 24' execute a pivot movement A and the entrainer runners 22 are spread. During this spreading the entrainer runners 22 engage the coupling elements 16, 18 at the shaft door side. The shaft-door leaf is thus coupled with the cage-door leaf 10 and in that case can be simultaneously unlocked. A second part movement of the door drive 6 opens the cage-door leaf 10 synchronously with a shaft-door leaf (not illustrated). A closing and decoupling of the door leaf takes place in reverse sequence.

The cage-door/shaft-door coupling 20 illustrated in general in FIG. 1 can be replaced by a cage-door/shaft-door coupling. This cage-door/shaft-door coupling can also be fastened to the shaft-door leaf. Correspondingly, the coupling device with coupling elements, which according to FIG. 1 are associated with the shaft door side, can also be arranged at the cage door side.

Figure 2:
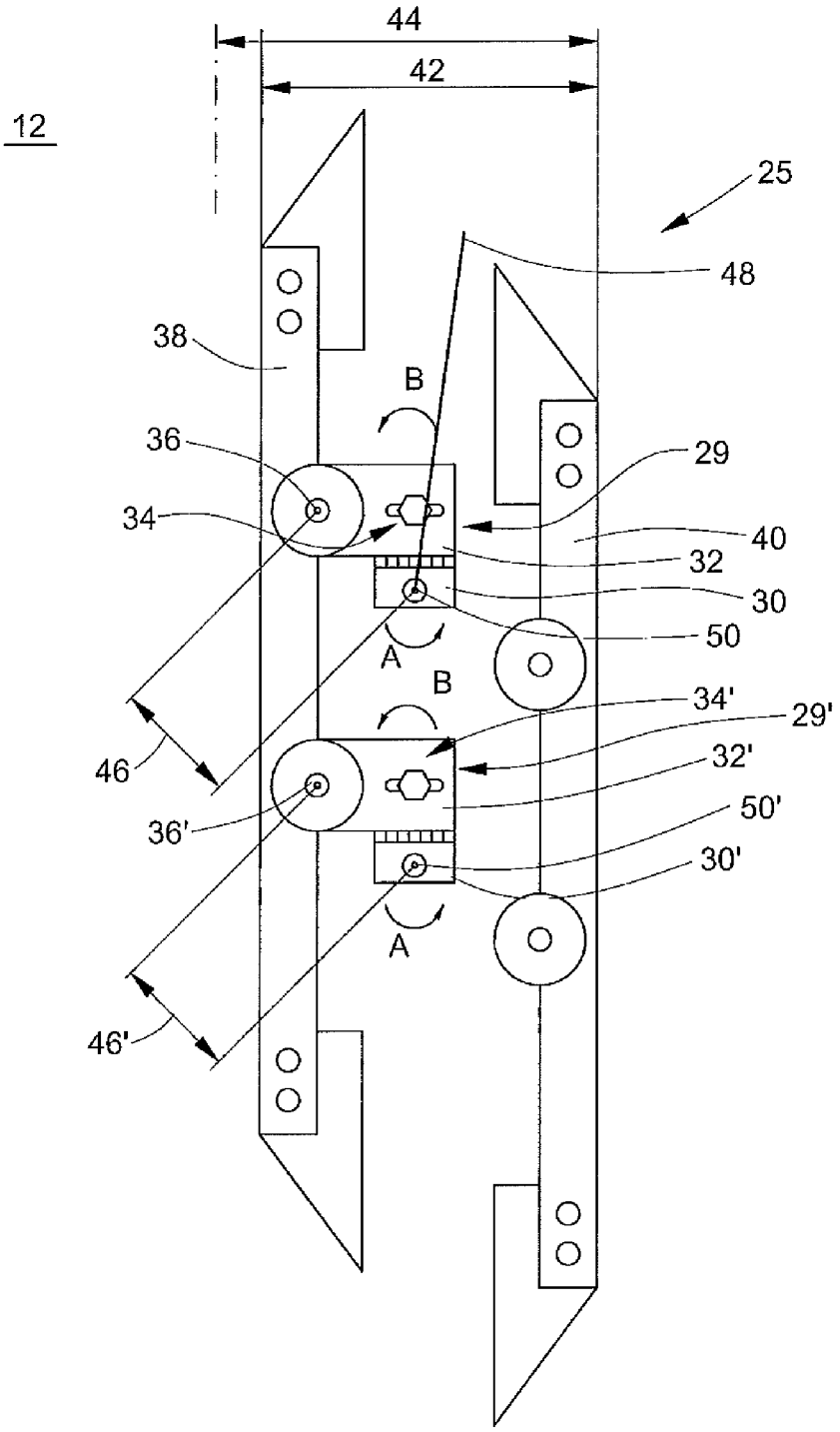
FIG. 2 shows a first cage-door/shaft-door coupling.
Figure 3:
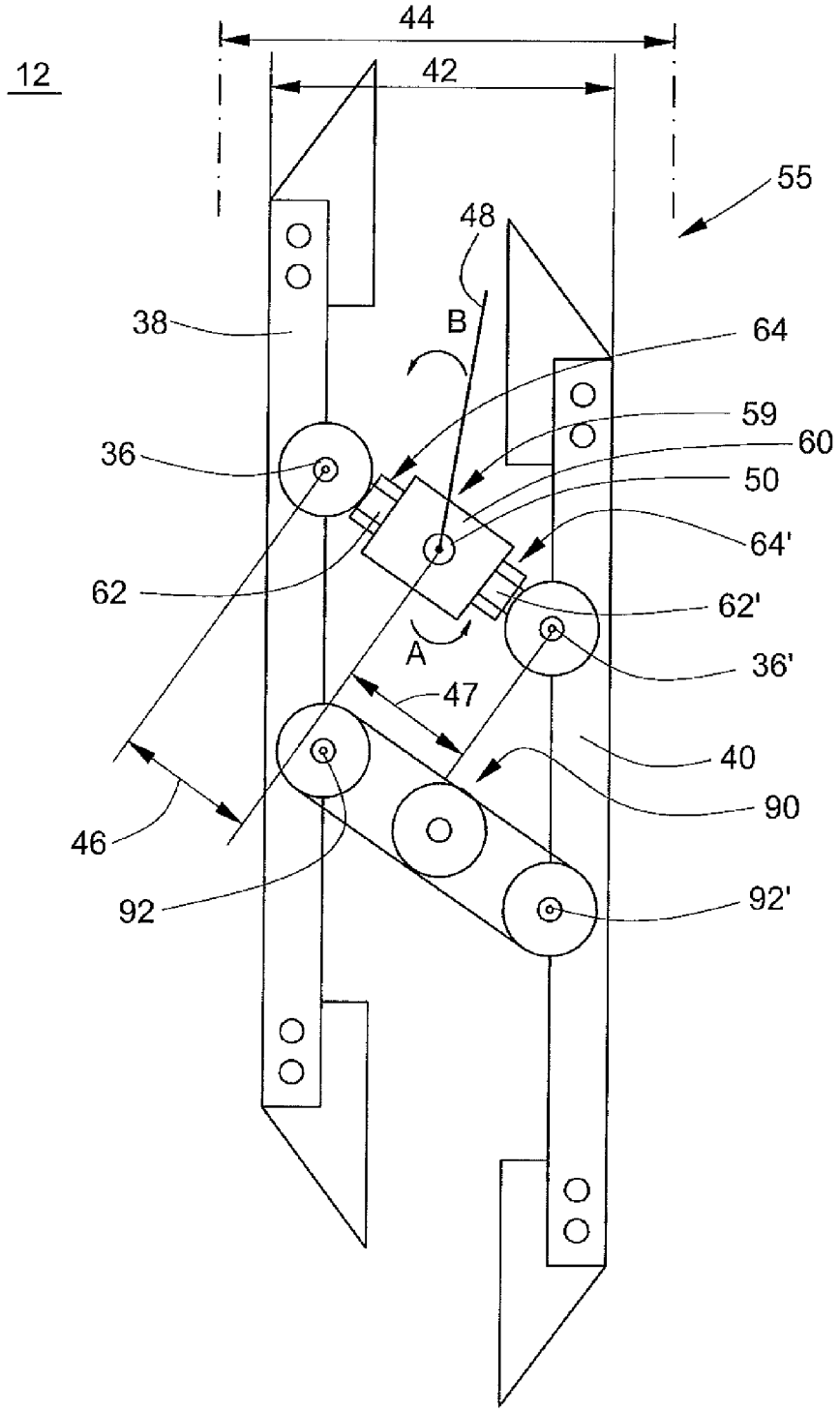
FIG. 3 shows a further cage-door/shaft-door coupling.

FIG. 2 and FIG. 3 show cage-door/shaft-door couplings 25, 55, which are fixed to a carriage 12 of an elevator installation. The respective cage-door/shaft-door coupling 25, 55 is actuated by an actuating element 48. The actuating element 48 is coupled to a door drive, which is not illustrated. The cage-door/shaft-door coupling 25, 55 comprises a first pivot lever 29, 59, a first entrainer runner 38 and a second entrainer runner 40. The entrainer runners 38, 40 are arranged parallel to one another. The pivot lever 29, 59 is pivotably mounted at an axis 50 of rotation associated therewith and is connected at this axis 50 of rotation with the actuating element 48. The pivot lever 29, 59 has, in addition, a joint point 36, at which the first entrainer runner 38 is mounted.

The pivot lever 29, 59 comprises a base member 30, 60 and a setting element 32, 62. The pivot lever 29, 59 has a settable fixing means 34, 64. The axis 50 of rotation is associated with the base member 30, 60 and the joint point 36 associated with the setting element 32, 62. The setting element 32, 62 is attached to the base member 30, 60 by means of the settable fixing means 34, 64. The settable fixing means 34, 64 makes possible a change of a spacing 46 between the joint point 36 and the axis 50 of rotation. The forms of embodiment, which are explained in this description, of such a settable fixing means 34, 64 are to be considered exemplifying.

A spacing of the two entrainer runners 38, 40 in the unactuated state of the cage-door/shaft-door coupling 25, 55 is characterized by a runner spacing 42. A part movement of the door drive results in a movement B of the actuating element 48. Starting from the unactuated state the pivot lever 29, 59 coupled with the actuating element executes at the same time as the movement B a pivot movement A about the fulcrum 50. If the pivot movement A is executed, a spacing of the entrainer runners 38, 40 is characterized by a runner coupling spacing 44. Regardless of the pivot movement A, an orientation of the entrainer runners 38, 40 is maintained. Through the variation of the settable fixing means 34, 64 and the change—which is connected therewith—of the spacing 46, the runner spacing 42 and the runner coupling spacing 44 are variable. Consequently, the cage-door/shaft-door coupling 25, 55 is usable in elevator installations with different coupling devices at the shaft door side. Instead of the illustrated fixing of the cage-door/shaft-door coupling 25, 55 to the carriage 12, the cage-door/shaft-door coupling 25, 55 can also be fastened at least partly to a cage-door leaf. At least one further pivot lever with at least one settable fixing means can be a component of the cage-door/shaft-door coupling 25, 55.

FIG. 2 shows a first embodiment of the cage-door/shaft-door coupling 25. Maintenance of the orientation of the entrainer runner 38 can be guaranteed by a second pivot lever 29' with a joint point 36'. The second pivot lever 29' is mounted at an axis 50' of rotation and, analogously to the first pivot lever 29, comprises a base member 30' and a setting element 32'. The pivot lever comprises a settable fixing means 34'. The setting fixing means 34' makes possible, also at the second pivot lever 29', a change of a spacing 46' between the joint point 36' and the rotational axis 50' of rotation. The second pivot lever 29' in that case similarly executes a pivot movement A about the axis 50' of rotation. The second entrainer runner 40 is fastened to the carriage 12. A change of the spacing of the entrainer runners 38, 40 when the pivot movement A takes place consequently arises from a movement of the first entrainer runner 38. Further pivot levers can be components of the cage-door/shaft-door coupling 25. The illustrated settable fixing means 34, 34' is explained in more detail by way of explanations with respect to FIG. 4.

However, the second entrainer runner 40 can also, as shown in FIG. 3 at the cage-door/shaft-door coupling 55, be connected with the pivot lever 59. The pivot lever 59 additionally comprises a second setting element 62' and has a second settable fixing means 64'. The second settable fixing means 64' makes possible a variable attachment of the second setting element 62' to the base member 60. The second setting element 62' has a second joint point 36', at which the second entrainer runner 40 is mounted. A spacing between the axis 50 of rotation and the second joint point 36' is a variable spacing 47. Threaded bores in the base member 60 and threads, with which the setting elements 62, 62' are provided, are part of the settable fixing means 64, 64'. The setting elements 62, 62' can be firmly screwed into the threaded bores of the base member 60 by means of auxiliary elements such as, for example, screws and fixed, so that the spacings 46, 47 between the joint points 36, 36' and the axis 50 of rotation can thereby be varied independently of one another. Alternatively, the threaded bore can be associated with one of the setting elements 62, 62' and the thread with the base member 60. The second joint point 36' can also be arranged on the base member 60. In this case the spacing 47 would not be variable. A provided parallel orientation of the entrainer runners 38, 40 can be ensured by a parallel guide device 90, at which the entrainer runner 38, 40 are mounted at joint points 92, 92'. The orientation of only one of the entrainer runners 38, 40 can also be guaranteed by a parallel guide device if the other one of the entrainer runners 38, 40 is, for example, fixed to the carriage 12.

Figures 4, 5:
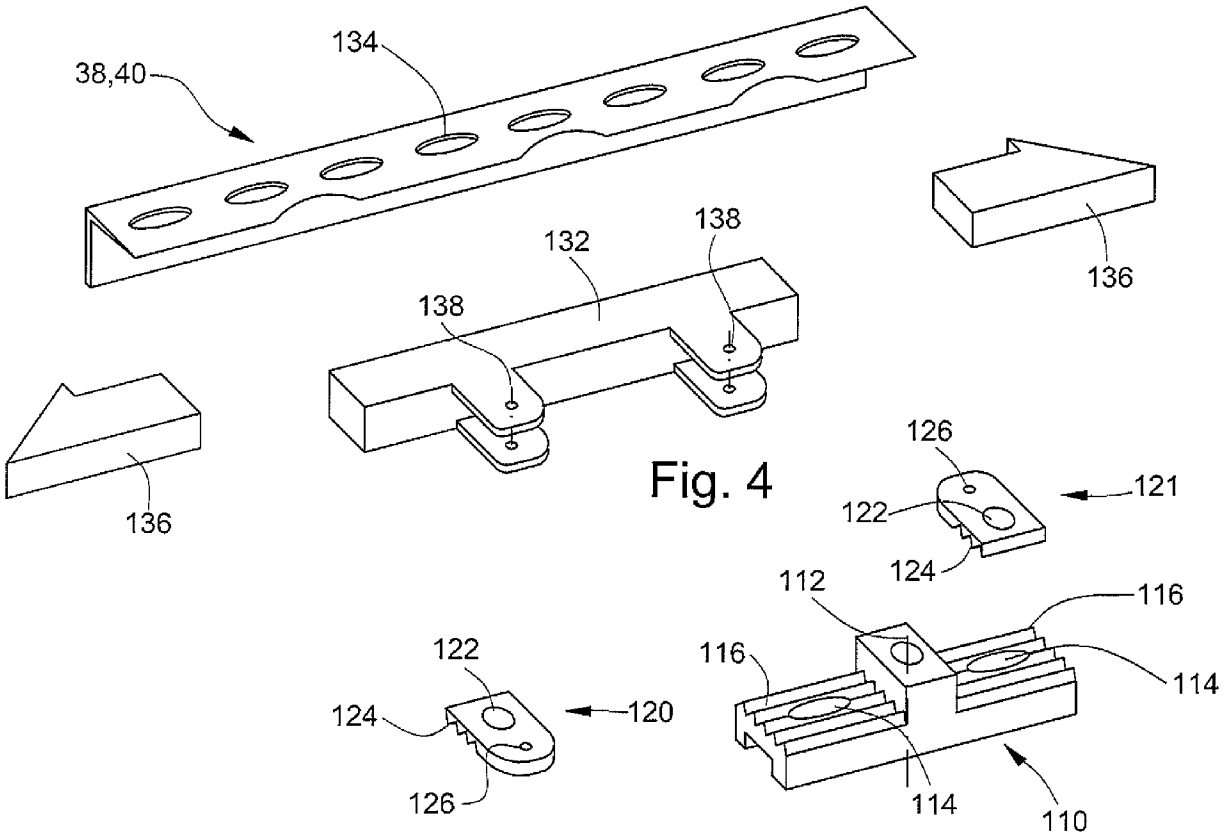
FIG. 4 shows components of a pivot lever of a cage-door/shaft-door coupling.
FIG. 5 shows entrainer runner elements of an entrainer runner of a cage-door/shaft-door coupling.

FIG. 4 shows, by way of example, components of a pivot lever of a cage-door/shaft-door coupling. Illustrated components of the pivot lever are a base member 110 with two associated setting elements 120, 121. The base member 110 has an axis 112 at which the base member 110 can be pivotably mounted at a mentioned axis of rotation. The setting elements 120, 121 are each provided with a respective joint point 126, at which a respective entrainer runner of the cage-door/shaft-door coupling can be mounted. The base member 110 and/or at least one of the setting elements 120, 121 can be provided with slots 114, 122 as part of a settable fixing means, such as illustrated by way of example in FIG. 2. With the help of fastening elements such as, for example, elements of a screw connection one of the setting elements 120, 121 can be fixed at the base member 110 through the slots 114, 122, so that this setting element 120, 121 can be displaced on the base member 110 depending on the respective alignment of the slot 114, 122. The respective setting element 120, 121 can therefore be fastened to the base member 110 at several positions. A spacing between the joint point 126 and the axle 112 can thus be changed. As an alternative to formation of slots 114, 122, the base member 110 and/or the setting element 120 can also be provided with hole rows. Hole rows enable, in addition to a plurality of possible spacings settable between the respective joint point 126 and the axis 112, a precise setting of this spacing. In correspondence with the form of embodiment shown in FIG. 2, a fastening of a single setting element 120 on the base member 110 can be sufficient in order to provide a cage-door/shaft-door coupling. The base member 110 can in this case have a second joint point.

The base member 110 and/or at least one of the setting elements 120, 121 can have within the mutual contact region thereof a toothing 116, 124 in order to simplify the settable fixing. In that case it does not matter whether the toothing 116, 124 is stamped out to be rectilinear, in the form of the illustrated grooves or, for example, by means of punctiform elevations. The dimensions of the toothing such as, for example, a depth of the grooves are oriented towards a requisite usefulness.

Instead of a construction of the settable fixing means according to one of the possibilities shown in FIGS. 2 to 4, use can also be made of other conventional devices in order to realize the variable fastening of a setting element to a base member, for example a screw connection or clamping connection.

FIG. 5 shows entrainer runner elements of an entrainer runner 38, 40 of a cage-door/shaft-door coupling. The entrainer runner elements comprise a parallelogram member 132 and an elongate section 134. Two runner terminals 136 can be mounted at the ends of the elongate section. The parallelogram member 132 has two mounting axes 138 which can be connected with joint points of pivot levers. The longitudinal section 134 can be mounted on the parallelogram member 132 regardless of its length. An elongate section 134 in a maximum reasonably anticipated length can be supplied in association with each entrainer runner 38, 40 of the cage-door/shaft-door coupling. A length of the entrainer runner 38, 40 can thus be matched to a coupling device at the shaft door side in that the elongate member 134 is shortened.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. A coupling for an elevator cage door and an elevator shaft door, the coupling comprising:

a first pivot lever pivotably mounted at a first axis of rotation, the first pivot lever comprising a first joint point, a first base member and a first setting element fastened to the first base member by a first settable fixing member, the first settable fixing member enabling a change in a spacing between the first joint point and the first axis of rotation and a fixing of the spacing between the first joint point and the first axis of rotation during a coupling process of the elevator cage door;

a second pivot lever pivotably mounted at a second axis of rotation, the second pivot lever comprising a second joint point, the first and second axes of rotation and the first and second joint points defining corners of a parallelogram in a plane extending at right angles to the first and second axes of rotation; and a first entrainer runner mounted at the first and second joint points.

2. The coupling of claim 1, the first axis of rotation being associated with the first base member, and the first joint point being associated with the first setting element.

3. The coupling of claim 1, the second pivot lever further comprising a second base member and a second setting element fastened to the second base member by a second settable fixing member.

4. The coupling of claim 3, further comprising a second entrainer runner.

5. The coupling of claim 4, the second entrainer runner being fixable to a door and parallel to the first entrainer runner.

6. The coupling of claim 1, the first settable fixing member comprising a slot or hole in the first setting element.

7. The coupling of claim 6, the first setting element comprising a toothing.

8. The coupling of claim 1, the first settable fixing member comprising a slot or hole in the first base member.

9. The coupling of claim 8, the first base member comprising a toothing.

10. The coupling of claim 1, the first settable fixing member comprising a screw connection of the first setting element.

11. The coupling of claim 1, the first settable fixing member comprising a screw connection of the first base member.

12. The coupling of claim 1, the first entrainer runner comprising entrainer runner elements.

13. The coupling of claim 12, the entrainer runner elements comprising:

a first entrainer runner element, the first entrainer runner element comprising an elongate section;

a second entrainer runner element, the second entrainer runner element comprising a first runner terminal; and a third entrainer runner element, the third entrainer runner element comprising a second runner terminal, the first and second runner terminals being fastened to the elongate section.

14. An elevator installation, comprising:

an elevator cage door;

an elevator shaft door; and a coupling for the elevator cage door and the elevator shaft door, the coupling comprising, a first pivot lever pivotably mounted at a first axis of rotation, the first pivot lever comprising a first joint point, a first base member and a first setting element fastened to the first base member by a first settable fixing member, the first settable fixing member enabling a change in a spacing between the first joint point and the first axis of rotation and a fixing of the spacing between the first joint point and the first axis of rotation during a coupling process of the elevator cage door, a second pivot lever pivotably mounted at a second axis of rotation, the second pivot lever comprising a second joint point, the first and second axes of rotation and the first and second joint points defining corners of a parallelogram in a plane extending at right angles to the first and second axes of rotation, and a first entrainer runner mounted at the first and second joint points.

* * * * *